United States Patent [19]

Barbier et al.

[11] Patent Number: 4,829,314

[45] Date of Patent: May 9, 1989

[54] MICROWAVE PLANE ANTENNA SIMULTANEOUSLY RECEIVING TWO POLARIZATIONS

[75] Inventors: Pascal Barbier, Saint Maurice; Francis Falgat; Alain Sorel, both of Evreux, all of France

[73] Assignee: U.S. Philips Corporation, New York, N.Y.

[21] Appl. No.: 939,602

[22] Filed: Dec. 9, 1986

[30] Foreign Application Priority Data

Dec. 20, 1985 [FR] France ..... 85 18924

[51] Int. Cl.[4] ..... H013 13/08

[52] U.S. Cl. ..... 343/778; 343/786

[58] Field of Search ..... 343/769, 777, 778, 786, 343/787, 799, 756, 700 MS File

[56] References Cited

U.S. PATENT DOCUMENTS 4,527,165 7/1985 de Ronde ..... 343/778
4,614,947 9/1986 Rammos ..... 343/778
4,644,362 2/1987 Rammos ..... 343/778

FOREIGN PATENT DOCUMENTS 0467952 11/1974 Australia ..... 343/786
0667709 7/1963 Canada ..... 343/776
1269950 4/1972 United Kingdom ..... 343/786

*Primary Examiner*—William L. Sikes
*Assistant Examiner*—Doris J. Johnson
*Attorney, Agent, or Firm*—Robert J. Kraus

[57] ABSTRACT

Multi-element microwave plane antenna for receiving satellite television signals with two simultaneous polarizations. The antenna is provided with two systems of lines (1) whose ends (3, 30) form probes emerging into wave-guides (2). The probes of one system (3) are perpendicular to those of the other system (30). Between the two systems of lines there is placed only a thin sheet (150) bored with cross-shaped cut-outs (6), and provided with separating studs made from a silk-screen-printed insulating material.

5 Claims, 2 Drawing Sheets

MICROWAVE PLANE ANTENNA SIMULTANEOUSLY RECEIVING TWO POLARIZATIONS

BACKGROUND OF THE INVENTION

The present invention relates to a microwave plane antenna formed from a number of radiating elements (receivers or, according to the principle of reciprocity of antennas, transmitters), provided in order to operate simultaneously with two different polarizations of waves, having for this purpose two systems of planar lines each placed on one sheet of dielectric of the "completely suspended substrate lines" type enclosed between devices that are at least locally metallic or metallized in which cut-outs placed opposite each other are bored in order to form elementary open or closed waveguides, the ends of the central conductors of the planar lines being placed inside these waveguides in order to form probes which produce a coupling enabling the reception (or transmission) of microwave signals.

Such antennas are used in particular for receiving satellite television transmissions at a frequency of about 12 GHz and circularly polarized.

A microwave plane antenna including an assembly of such elements has been described in the French patent application No. 2544920 corresponding to U.S. Pat. No. 4,614,947. In it there is in particular described an arrangement enabling the transmission lines forming the antenna feed system or systems to be supported. Each of the systems of microwave lines is formed by a printed circuit deposited on a thin sheet of dielectric serving as a substrate enclosed between two metallic plates or between two metallized dielectric plates. Each system is placed in such a way that the ends of the central conductors of the lines are facing square cut-outs bored in each of the plates which enclose it respectively in order to produce the coupling between the lines and the cut-outs. Each sheet of dielectric carrying the system of printed central conductors of the microwave lines is supported between the plates which enclose it by positioning studs located on the surfaces of these plates, facing each other and on either side of this sheet, these studs alos being placed, with respect to this sheet, in spaces having no printed circuits.

The antenna is intended to operate in circular polarization. Two solutions are known: the first consists in the use of a coupler known as a "3 dB coupler" whose inputs are connected to the two systems sensitive to the two orthogonal linear polarizations; both directions of circular polarization are thus obtained simultaneously, each on one output of the coupler. This solution has the disadvantage, particularly for large antennas, of imposing a high precision of production on the two systems of lines connecting the probes in the waveguides to the inputs of the coupler, as the electrical lengths must be equal, any phase shift degrading the purity of circular polarization. It will therefore only be used for small antennas. Also, it would still impose the presence of two systems in the same antenna even if only one single direction of polarization was required to be received.

Another solution is provided by the use of a grid depolarizer placed in front of the antenna. This can be one of several known types: formed from wires, from meandering lines or from metallic strips. Both directions of circular polarization are then simultaneously available at the output of each circuit. This solution reduces the accuracy requirement on the systems of lines and therefore facilitates their manufacture. Also it would enable the use of only a single system if only one single direction of polarization was required to be received. In order to obtain a weak contrapolar component ratio, in the present case in which two polarizations are received, the two orthogonal systems must be decoupled; there does however exist a parasitic coupling between the two systems due to the fact that the probes of one system are close to those of the other system. The usual method for reducing this coupling consists in moving the probes away from each other, i.e. moving the two planes of the systems of lines away from each other, which has the disadvantage of making it difficult to perfectly match both probes at the same time with the same short-circuit plane behind these probes. Also, this separation requires an additional set of waveguides between the two systems of lines, which increases the cost and dimensions of the antenna.

SUMMARY OF THE INVENTION

In order to remedy these disadvantages, the antenna according to the invention is in particular characterized in that the device situated between the two systems of lines is of low thickness with respect to the wave-length and the cut-outs with which it is bored are cross-shaped.

Cross-shaped cut-outs enable a reduction in the mutual coupling between two orthogonal probes, by a greater attenuation of the upper modes than with a square cut-out, as cross-shaped guides have an effect comparable with that of two rectangular guides placed orthogonally, in which the cut-off frequency of the TE11 and TM11 modes is higher than in a square guide of side equal to the large side of the rectangles. Because of this it is possible to bring the planes of the two systems closer together, which reduces the cost and the dimensions.

Advantageously, the device situated between the two systems is a thin plate bored with cross-shaped holes and provided with studs for holding the sheets of dielectric at a distance and this plate is a plane sheet on the two surfaces of which the studs are inserted by silk-screen printing and made from dielectric material.

According to a variant, the plate is made from two plane sheets applied to each other, each sheet being provided on its external surface with studs placed by silk-screen printing and made from dielectric material.

This structure is particularly economical as a simple punched sheet is sufficient in this case to form the waveguide device, and also the silk-screen printed dielectric material studs are of simpler manufacture and they improve the performance of the antenna.

The antenna according to the prior art also has the disadvantage that the plates, forming both the main framework of the antenna and the waveguide system, must be very rigid and have high dimensional accuracy. Metal plates with such a complex structure are expensive and also very heavy. Plates made from metallized plastic material have heat expansion characteristics that are not appropriate for the production of a large sized antenna which must operate equally well at −40° as in the summer sunshine.

In order to remedy these disadvantages, the antenna according to the invention is particularly characterized in that the "plates" in it are replaced by composite devices each formed by a thin sheet bored with cut-outs, on one surface of which is applied at least one unit forming a number of waveguides, and on the other surface of which are located the separating studs, and in that the assembly of sheets is supported by a single rigid chassis.

The unit forming a number of waveguides is inserted on the sheet and supported by it; it is not therefore subject to severe mechanical precision requirements and can therefore be produced economically. The thin sheet is relatively flexible, and held in position by the chassis, which therefore forms a kind of slab in order to keep the sheets flat. Therefore there is now a single rigid part: the chassis, which holds several sheets, instead of the several complex self-supporting plates of the prior art.

BRIEF DESCRIPTION OF THE DRAWING

The following description, given with reference to the appended drawings figures and describing non-limiting examples, will give a good understanding of how the invention may be embodied.

DESCRIPTION OF THE PREFERRED EMBODIMENTS

Figure 1:
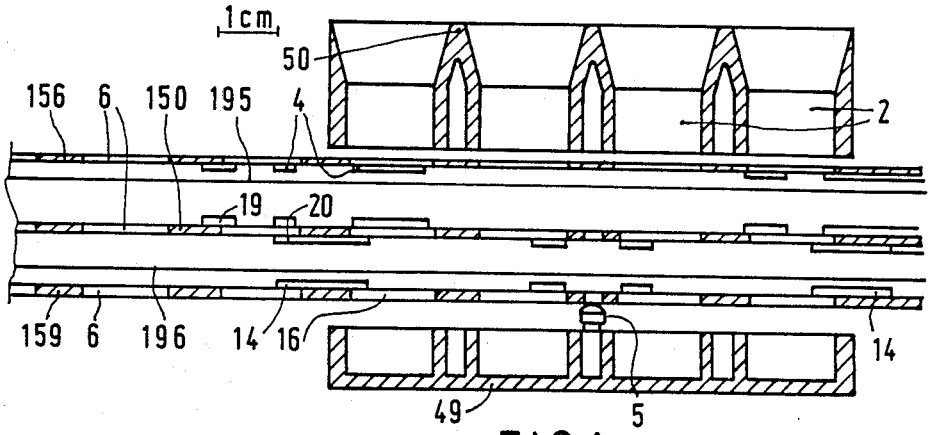
FIG. 1 shows a cross-section of part of an antenna including two systems of microwave lines, produced according to the invention.
Figure 2:
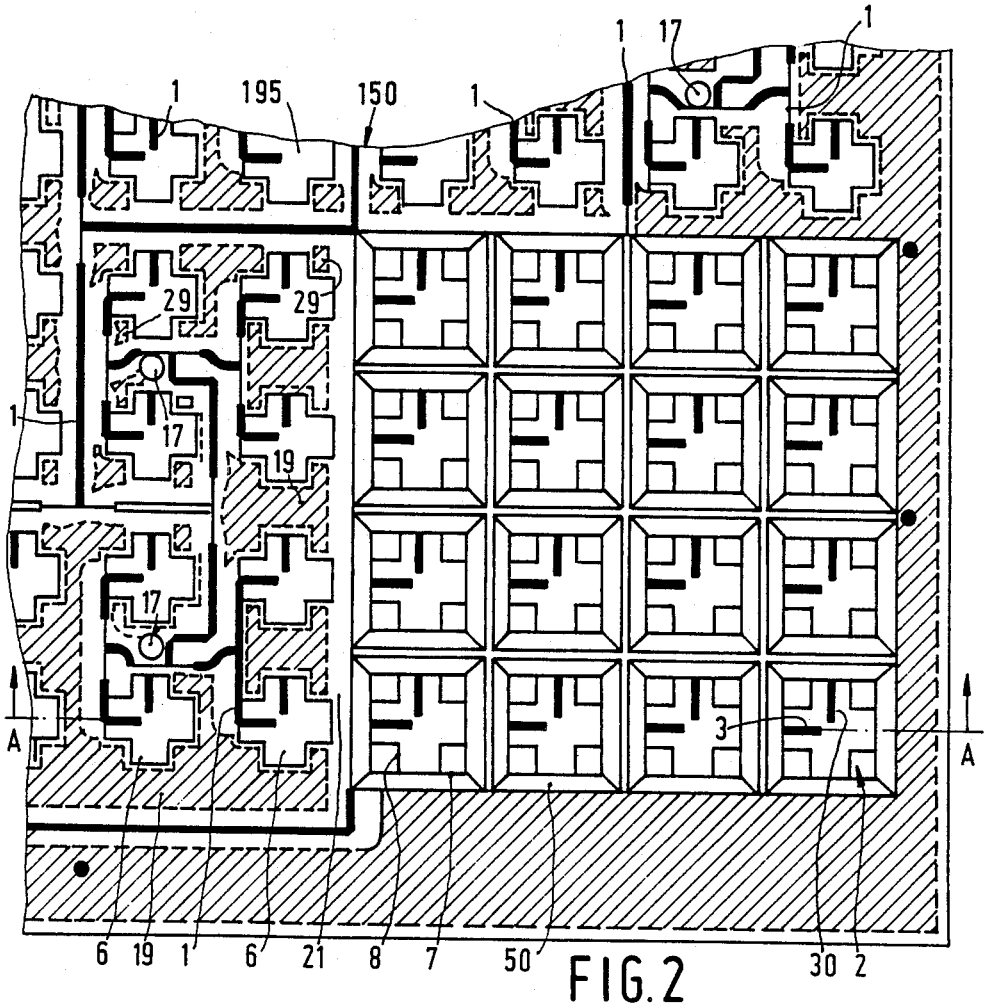
FIG. 2 shows a plan view of the same antenna part.

FIG. 1, which is a cross-section view along line A of FIG. 2, shows components of an antenna separated from each other in order to make the figure more clear. The antenna is formed from a system of planar lines placed on a dielectric sheet 195 and a second similar system placed on a dielectric sheet 196, these systems are each enclosed between devices made from metallic or metallized material. The lines carried by the sheets 195 and 196 are not shown, as their thickness, at the scale of the drawing, is too small for them to be seen. There are here three devices made from metallic or metallized material; one is placed above the system 195, a second is placed between the systems 195, 196 and the third is placed below the system 196. One of these devices includes the elements referenced 50 and 156, another of these devices includes the elements referenced 49 and 159. The device situated between the two systems of lines is of low thickness with respect to the wavelength. It is formed from a thin plate 150 bored with holes 6 and provided with studs 19, 20 to hold the sheets 195, 196 at a distance. This plate 150 is a plane sheet on the two surfaces of which are inserted, by silkscreen printing, the studs 19, 20 made from a dielectric material. In all these devices are bored cut-outs which form elementary waveguides 2, into which the ends of the lines lead, as will appear more clearly in the description of FIG. 2. Studs 4, 14, are also provided on the upper and lower devices in order to hold the sheets of dielectric 195, 196 at a certain distance from the said devices. One of these devices is formed from a plane sheet 156 bored with holes 7, on one surface of which is applied a unit 50 forming a number of waveguides 2, and on the other surface of which are located separating studs 4. Another of these devices is formed in a similar way by the sheet 159 bored with holes 6, the unit 49, forming waveguides, and separating studs 14.

The sheets 156, 150, 159, are produced from aluminium and have a thickness of 1 mm, the units 49, 50 are moulded, for example from thermoplastic material, known as "ABS" and metallized, and the dielectric sheets carrying the systems of lines are produced from a Mylar sheet of thickness 70 microns and covered with a sheet of copper of thickness 35 microns which is etched in order to form the lines. It is possible to use even lower thicknesses for the dielectric sheet for the purpose of further reducing the losses; it would for example be possible to use a Kapton sheet of of thickness 25 microns, but this latter material is more expensive than the Mylar sheet. The material used to form the studs is advantageously loaded with particles of dielectric material; these particles are for example balls, possibly hollow, made from glass or plastic material. The silkscreen printed separating studs 4, 14, 19, 20 are 0.8 mm thick. They are produced by means of silk-screen printing using a screen of adequate thickness; the screen is formed from a sheet with meshes large enough to allow the balls to pass through, covered by one or more layers providing the required thickness, made from photosensitive material, and the patterns of the studs are obtained, by means of photographic processing, on this screen.

FIG. 2 shows the same components as FIG. 1, but without the upper sheet 156 in order to show the system of lines 1. These lines generally have a width of 1.8 mm. They have narrower sections at the "T" connection points for impedance matching. The silk-screen printed studs 19, 29 of the sheet 157 are seen by transparency through the mylar sheet 195.

The cut-outs 6 in the sheet 150 are in the shape of a cross while the waveguides 2 have a square crosssection. References 7 and 8, indicating a point on the perimeter of the waveguide and a point on the perimeter of the cut-out respectively, show how they are positioned with respect to each other. The cut-outs in the upper and lower sheets 156, 159, are also cross-shaped in order that all the sheets can be produced with the same tooling. Moreover, the waveguides 2 could also be cross-shaped, but it is not advantageous for these as this unnecessarily complicates the manufacturing tooling. This shape is only truly indispensable for the sheet situated between the two planes of the networks of lines 195, 196.

The separating studs 19, seen through the sheet 195, are represented by cross-hatched areas surrounded by dotted lines. The silk-screen printed areas forming these studs practically represent a negative image of the network of lines, an image in which these lines would be widened. By "negative" it is understood that the impervious material in the silk screen is located in the places where the lines are present. An image of the silk-screen-printed areas can easily be obtained by means of conventional computer-aided drawing equipment. With this equipment it is possible to draw strips having a same median line as the microwave lines, but wider, and to add the system of cross-shaped cut-outs. It is possible to produce the same drawing without such equipment. In this case a negative of the lines shown transparent on a black background must be used and a duplicate negative produced from it by moving the negative in all directions during the exposure. The amplitude of this movement is of course equal to the desired enlargement for the lines. In this way a drawing in black of the enlarged lines is obtained which it is then sufficient to superimpose on the drawing in black of the cut-outs.

Reference numeral 3 indicates the end of one line of the system carried by sheet 195 and this end emerges into waveguide 2 in order to produce a coupling probe enabling the reception of microwave signals; reference numeral 30 similarly indicates a probe of the system carried by the dielectric sheet 196. The width of the probes must be slightly increased with respect to that of the lines. It is approximately 2.5 mm.

The interval between two rows of cut-outs in both directions is 23 mm.

Only one waveguide unit 50 has been shown in the FIG. 2 in order to leave the system of lines visible at the side of this unit. It is obvious that other waveguide units similar to unit 50 must be mounted over the entire surface of the antenna; these units are separate from each other which enables a reduction in the effect of different expansions of the plastic material of these units on the one hand and of the aluminium forming the sheets on the other hand. The waveguide units 50 are provided with locating pins such as 5 on FIG. 1, which enable the fixing of the units 50 onto the sheets. Holes 17, intended to receive these pins, are visible in FIG. 2.

The repetitive configuration of the system of lines enables easy reconstruction of the rest of the antenna which is not shown in FIG. 2. An antenna can for example be formed by sixteen units 50 each including sixteen waveguides 2 arranged in a rectangle of eight by two units. The design of the system of lines carried by sheet 196 is different from that shown in FIG. 2 in such a way that the lines emerge perpendicular to those of sheet 195. The design of this system (not shown) can easily be imagined from the drawing shown. In addition, diagrammatic examples of these two designs are given in the patent application quoted in the introduction.

It is easy to understand that the separating studs 4 and 19 or 20 and 24 could also have been deposited by silk-screen printing on both surfaces of each sheet 195, 196 instead of being deposited on the metallic sheets 156 150, 159. However, depositing on the sheets is much easier.

Figure 3:
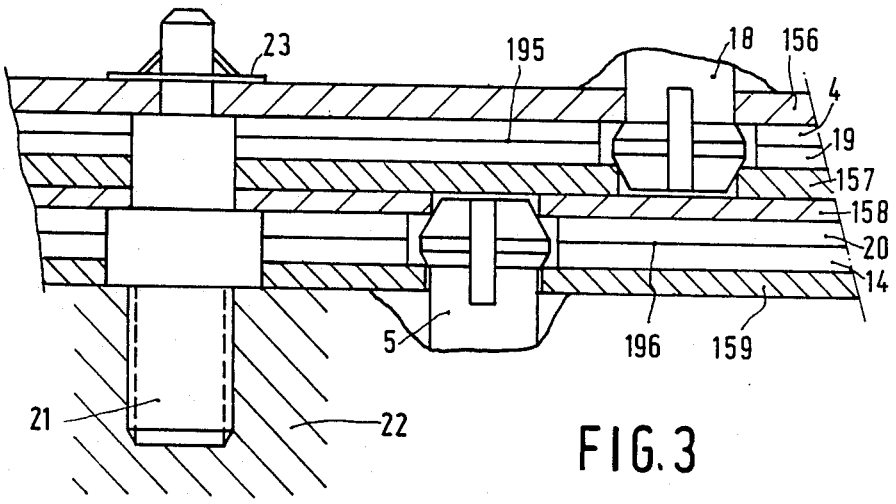
FIG. 3 shows an example of a method of fixing the components of the antenna to each other.

FIG. 3 shows means of assembly of the antenna in detail. In this figure sheets 156 and 159 appear again, provided with separating areas 4 and 14 and enclosing sheets 195 and 196 respectively. This is a variant in which the plate 150 of FIG. 1 is made from two plane sheets 157, 158 placedone on top of the other, each sheet being provided on its external surface with studs 19 and 20 respectively.

The locating pin 18, belonging to the upper open waveguide unit, is fixed in a hole in sheets 156 and 157. The locating pin 5, belongint to the lower closed waveguide block, is fixed in a hole in sheets 159 and 158. Sheet 157 is applied directly against sheet 158. The use of two sheets can be useful, as it is difficult to find free locations (without silk-screen printed studs) at the same position on both surfaces of the central plate 157, 158, in order to locate a hole in this position in order to receive a locating pin 5, 18. The use of two sheets therefore enables the placing of the holes at different positions on each sheet, without emerging on the other surface of the plate. In addition it can be simpler to silk-screen print the studs 19, 20 on two separate sheets, subsequently placed back to back to each other, than on two surfaces of the same plate. The antenna assembly is mounted on a chassis of which a small section is shown cross-hatched at 22. A pin 21 is fixed in the material of the chassis and the stack forming the antenna, provided with adequate holes, is fixed to the chassis using such pins and clips 23 force-fitted onto the pins. In the case of a single sheet 150 as in FIG. 1, i.e. if it has been possible to find locations common to the two systems of lines for the holes 17 of FIG. 2, the pins 21 could pass through these holes and fix the sheets on the chassis and the waveguide units 50 at the same time.

Figure 4:
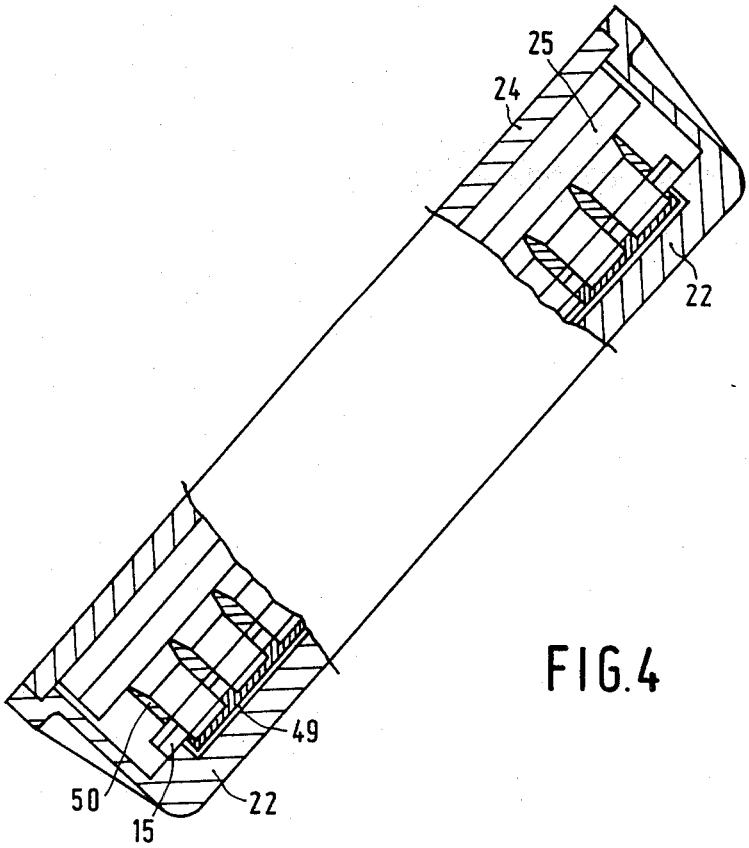
FIG. 4 shows, in partial cross-section, a complete antenna.

FIG. 4 shows a complete antenna: the two parts in cross-section each show a variant embodiment. It is obvious that in practice these two variants would not appear together in a same antenna!

At the bottom left, the variant is the same as that described in FIGS. 1 and 4. In this Figure the same references, 22 for the chassis, 49 and 50 for the waveguide units, appear again. Reference 15 includes the stack of sheets previously referenced 150 to 159. The antenna is housed in a protective casing, whose rear wall 22 forms the abovementioned chassis.

At the top right, the waveguide unit is formed by the walls 9, 10 described with reference to FIG. 3. The closed waveguides placed at the rear of the stack 15 are formed by cut-outs 23 cut directly into the surface of the chassis 22, which is here the rear wall of the housing, applied to the rear surface of the rear sheet of the stack 15.

In front of the previously described components, there is placed a wire depolarizer 25, of a known pattern, and a cover 24 to close the housing, this cover of course being transparent to electromagnetic radiation, made from polyurethane for example.

The housing is produced by moulding. It can be metallic, but it is more advantageous to produce it in the same material as the cover 24, which enables the economical production of an assembly which is sealed with this cover by adhesive.

It is obvious that the application of the invention to the reception of 12 gigahertz television signals retransmitted by satellite is not limiting. On the one hand, the invention is applicable to all kinds of purely terrestrial microwave transmission systems and, on the other hand, the choice of an example of application at the frequency of 12 gigahertz is not exclusive of any other operating frequency, in the microwave range, associated with such other envisaged application. The dimensions of the waveguides and their spacing would then of course have to be modified.

What is claimed is:

1. A planar high-frequency antenna including, in order:

a. a rigid waveguide unit of material having a plurality of openings therethrough bounded by conductive surfaces defining respective waveguides;

b. a first planar member having openings therethrough aligned with the openings in the rigid block and bounded by conductive surfaces defining continuations of the respective waveguides;

c. a second planar member of dielectric material bearing a network of strip conductors having ends extending into respective ones of the waveguides in a first direction;

d. a third planar member having cross-shaped openings therethrough aligned with the openings in the first planar member and bounded by conductive surfaces defining continuations of the respective waveguides, said third planar member having a thickness which is relatively small with respect to an operating wavelength of the antenna;

e. a fourth planar member of dielectric material bearing a network of strip conductors having ends extending into respective ones of the waveguides in a second direction perpendicular to the first direction;

f. a fifth planar member having openings therethrough aligned with the openings in the third planar member and bounded by conductive surfaces defining continuations of the respective waveguides;

g. a rigid chassis for supporting the planar members;

h. a first pattern of separating studs disposed between the first and second planar members, and a corresponding second pattern of separating studs disposed between the second and third planar members; and i. a third pattern of separating studs disposed between the third and fourth planar members, and a fourth pattern of separating studs disposed between the fourth and fifth planar members;

said patterns of studs being supported on respective ones of the planar members and being arranged to inflexibly secure the second and fourth planar members between solid portions of the rigid waveguide unit and the rigid chassis.

2. An antenna as in claim 1 where the patterns of studs are disposed on the first, third and fifth planar members.

3. An antenna as in claim 1 or 2 where the patterns of studs consist essentially of silk-screen-deposited dielectric material.

4. An antenna as in claim 1 or 2 where the third planar member comprises first and second sheets of material disposed on each other.

5. An antenna as in claim 1 or 2 where the openings in the rigid waveguide unit are square shaped.

* * * * *